United States Patent [19]

Mroz

[11] 4,215,556

[45] Aug. 5, 1980

[54] FINGER RING SECUREMENT DEVICE

[76] Inventor: Joseph A. Mroz, 1800 Deborah Dr., Lemay, Mo. 63125

[21] Appl. No.: 961,757

[22] Filed: Nov. 17, 1978

[51] Int. Cl.[3] ..... A44C 9/02

[52] U.S. Cl. ..... 63/15.6

[58] Field of Search ..... 63/15.6

[56] References Cited

U.S. PATENT DOCUMENTS

| | | | |
|---|---|---|---|
| 1,217,097 | 2/1917 | Levin | 63/15.6 |
| 3,218,826 | 11/1965 | De Santo | 63/15.6 |
| 3,465,544 | 9/1969 | Tucker | 63/15.6 |
| 3,590,598 | 7/1971 | Leone | 63/15.6 |

FOREIGN PATENT DOCUMENTS

| | | | |
|---|---|---|---|
| 16401 | of 1888 | United Kingdom | 63/15.6 |
| 1434513 | 5/1976 | United Kingdom | 63/15.6 |

*Primary Examiner*—F. Barry Shay

*Attorney, Agent, or Firm*—Kalish & Gilster

[57] ABSTRACT

A device as utilized in conjunction with a finger ring for purposes of securement of the ring upon the finger of the wearer includes a size-reducing element configured for fitting within the opening of the ring for interposition between an inner peripheral surface of the opening and a palmer surface of the finger. A hinge arrangement is provided for securement to an outer peripheral surface of the ring, there being an arm engaging said element and the hinge structure. The arm is pivotally secured with respect to the hinge structure to provide pivoting movement of the size-reducing element between an open position, permitting unencumbered insertion of the finger within the opening, and a closed position, wherein the size-reducing element is located within the opening for substantially preventing the ring from being withdrawn from the finger. The device is equipped for resiliently retaining the size-reducing element in the closed position.

7 Claims, 7 Drawing Figures

FIG. 1
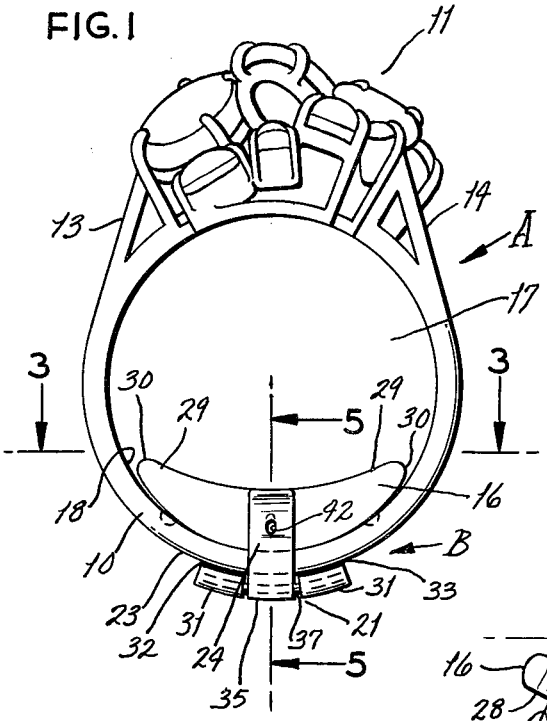
FIG. 2
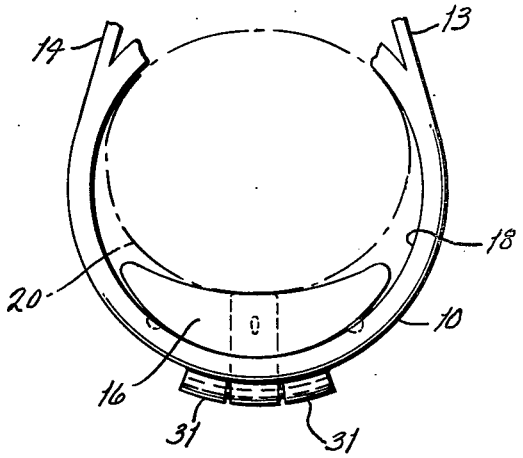
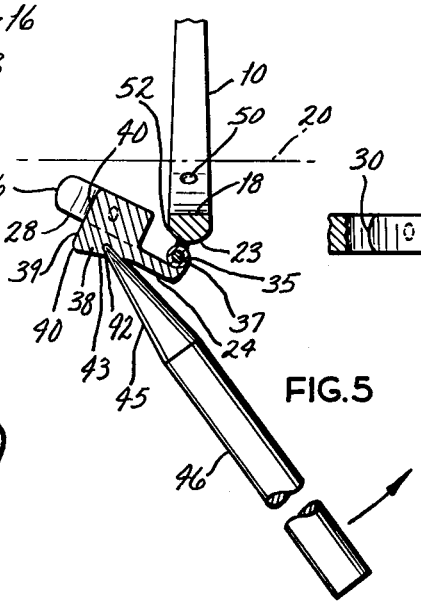
FIG. 5
FIG. 3
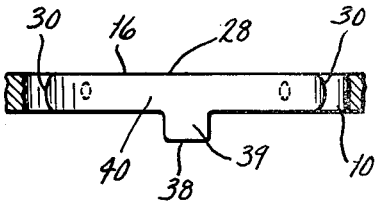
FIG. 4
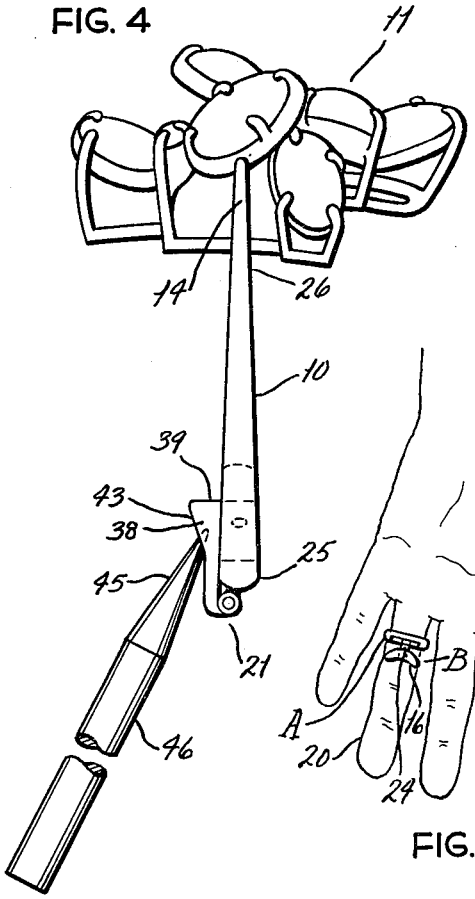
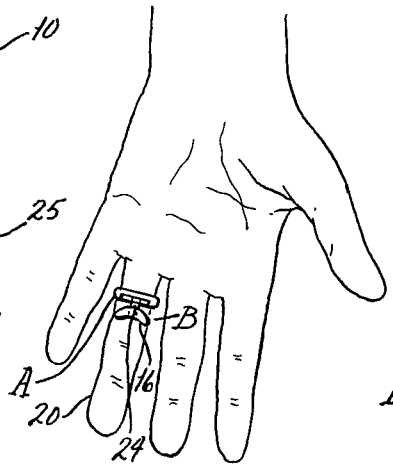
FIG. 7
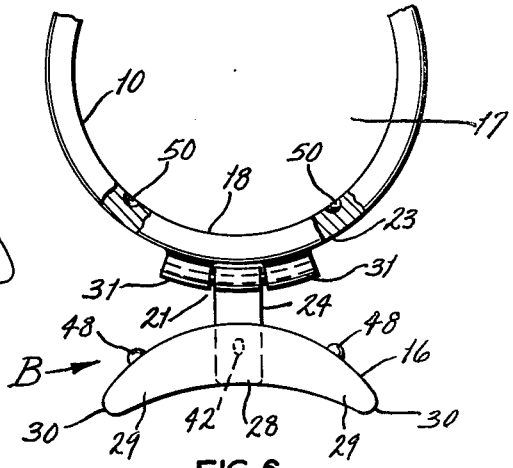
FIG. 6

FINGER RING SECUREMENT DEVICE

BACKGROUND AND SUMMARY OF THE INVENTION

The present invention relates to apparatus for enhancing the retention of a finger ring upon the wearer's finger and, more particularly, to a device which is attachable to a finger ring without substantial modification of the ring.

An age-old problem in the fitting of finger rings is that a wearer sometimes will have relatively large knuckles, whether by virtue of natural physiological characteristics, or through enlargement of the knuckles because of arthritic conditions or the like. If a ring is sized large enough to fit over the knuckle it is often too loose when it is past the knuckle and since it is not secured to the finger can be relatively easily withdrawn and will provide an objectionably loose fit upon the finger permitting the ring to turn about the finger in a most undesirable and bothersome fashion. The problem has either precluded the wearing of finger rings by persons having relatively large knuckles or has required that conventional shank of the ring be replaced by one having an adjustable shank, or otherwise modified to permit a portion of the shank to be swung away for placing of the ring upon the wearer's finger and for then subsequently closing the shank.

Heretofore, numerous arrangements have been disclosed for hinged adjustable finger ring shanks to permit the adjustability of the size of the ring shank so that the ring shank can effectively be opened to permit the ring to be placed upon the finger of the wearer and with the shank then being subsequently closed and the clasp being fastened. Such arrangements are extremely expensive, difficult to install and require substantial expertise and effort, with consequent expenditure of time and utilization of skilled personnel to modify a ring to incorporate such adjustable shank. In addition, when a ring has thus been modified with such an adjustable shank, the modification is permanent and the ring may not be readily reconverted to its previous configuration. Thus, the conventional character of the ring is lost.

One such arrangement is an adjustable shank having a hinged portion secured by a clasp and available under the trade name RITE SIZE from a concern doing business apparently by such name at P.O. Box 1508, Council Bluffs, Iowa 51501, as evidenced by a mail brochure. But such arrangement requires replacement of the existing ring shank and, therefore, suffers from the foregoing disadvantages.

A further attempt at the solution of this problem is manifested by the modification of the shank of a ring in accordance with apparatus disclosed in Tucker U.S. Pat. No. 3,465,544 wherein a swingable element is secured to the ring itself by modification of the shank to include a reduced diameter portion, the swingable element being crescent-shaped to fit within the opening of the ring. There are numerous problems with the arrangements disclosed in the Tucker Patent, among which are that the shank of the ring must be rather extensively modified by a highly skilled artisan and, having once been modified, may no longer be returned to its normal condition without replacing the modified portion of the shank. Another difficulty inherent in that construction is that the size-reducing element must fit quite precisely within the ring in order to be retained in position and, since there are many ring sizes, a manufacturing jeweler who would wish to equip rings with such a device would have to maintain numerous ring size-reducing elements in stockage and this is objectionable because of cost and inventory requirements.

Another attempt of the prior art to provide adjustment of the size of the finger ring is that revealed by Leone U.S. Pat. No. 3,590,598 wherein an arcuate segment is pivotally secured to the shank of the ring, after the shank has been modified specially for this purpose, to reduce the internal ring size. A spring biased detent holds the dimension-reducing element releaseably in its position within the ring. But again, like that disclosed in the Tucker Patent the Leone constructions requires objectionable modification of the ring by a skilled manufacturing jeweler for the purpose of precisely reducing the shank so as to accommodate the size-reducing element which is secured to the reduced-shank portion.

Other constructions which have been known in the prior art include specially modified shanks which have telescoping or size adjusting features which must be inserted into the shank by cutting of the shank and inserting of the apparatus within the shank, all requiring the careful and time-consuming services of a highly skilled manufacturing jeweler. Many jewelers are not equipped or skilled for the modification of rings utilizing these various shank adjustment features and, thus, like the constructions disclosed in the Tucker and Leone Patents, they have not met with total acceptance in the jewelry trade.

Accordingly, a principal object of the present invention is the provision of an improved device for attachment to a finger ring for securement of the ring to the finger of a wearer, and particularly such a device which can be readily attached to a ring without requiring modification of the ring shank.

Another object of the invention is a device of the character stated which permits the ring to be placed on a wearer's finger which has enlarged knuckles and yet provides for securement of the ring upon the finger in a safe, comfortable relationship which precludes looseness or objectionable turning of the ring upon the finger.

A further object of the invention is the provision of a device of the character stated which is such that the ring is effectively prevented from being displaced from the wearer's finger upon attempt of withdrawal of the ring, yet is easily reconfigured to permit the ring to be readily withdrawn when desired.

A still further object of the invention is the provision of a device of the character stated which, when attached to the ring and configured in a position securing the ring upon the wearer's finger, can readily be reconfigured for removal of the ring through convenient use of a tool for such purpose.

Yet another object of the invention is the provision of a device of the character stated which is readily secured by a jeweler to the conventional shank of a ring without the use of specialized, critical or unusual expertise on the part of the jeweler and which, accordingly, conduces to extremely facile attachment to a ring.

A further related object of the invention is the provision of a device of the character stated which is easily constructed of a most minimal number of components and which components may be utilized for various different sizes of rings.

Another object of the invention is the provision of a device of the character stated which may be attached to a ring without destroying its conventional character and which could be removed by the jeweler from the ring, if later desired, returning the ring to its original character and in relatively unharmed condition.

Among still further objects of the invention may be noted the provision of a device of the character stated which is extremely simple in construction; long lasting in use; not prone to wear or disfunction in use; economically constructed; and amenable to low cost, relatively high volume manufacture; and which is conducive to simple, quick and economical attachment to rings by jewelers.

Other objects will be in part apparent and in part pointed out hereinbelow.

BRIEF DESCRIPTION OF THE DRAWINGS

FIG. 1 is an enlarged elevational view of a finger ring having a securement device constructed in accordance with and embodying the present invention, the device being attached to the shank of the ring.

FIG. 2 is a partial elevational view showing the shank of the ring of FIG. 1 and depicting the relationship of the shank and the subject device attached to the shank in mutual relationship to the finger of the wearer of the ring.

FIG. 3 is a horizontal cross-sectional view taken generally along line 3—3 of FIG. 1.

FIG. 4 is a side elevational view of the ring and device of the invention attached to the ring with a tool shown interengaged with the device for opening the size-reducing element thereof.

FIG. 5 is a fragmentary vertical cross-sectional view taken generally along line 5—5 of FIG. 1 but showing the tool of FIG. 4 interengaged with the device for opening of the size-reducing element.

FIG. 6 is a fragmentary elevational view of the ring and securement device of the invention attached thereto with the size-reducing element shown in an open position.

FIG. 7 is a pictorial representation in the nature of an elevational view depicting a ring to which a securement device of the present invention is the ring in position upon the finger of the wearer.

Corresponding reference characters indicate corresponding parts throughout the several views of the drawings.

DESCRIPTION OF THE PREFERRED EMBODIMENT

Referring now to the drawing, indicated generally at A is a finger ring of the type having a circular band or shank 10 at the top of which is located a setting 11 illustrative of various types of settings found upon rings, such setting having portions 13,14 which extend upward from the sides of shank 10. Secured to ring A is a device B of the invention which is utilized for securement of the ring upon a finger of the wearer of the ring.

As a matter of generality, device B comprises a size-reducing element 16 configured for fitting within the circular opening 17 of the ring for interposition between an inner peripheral surface 18 of opening 17 and a corresponding palmar surface of the finger which, in FIG. 2 is designated representatively at 20. Device B includes hinge means 21 for securement to the outer peripheral surface 23 of the shank 10 opposite from the inner peripheral surface 18 without necessitating modification of shank 10.

The device comprises an arm 24 interengaging element 16 and hinge means 21 to provide movement of the size-reducing element 16 between an open position, as depicted in FIG. 6 and a closed position as depicted in FIGS. 1 and 2. In the open position the size-reducing element 16 is displaced from opening 17 for permitting unemcumbered insertion of the finger 20 within the opening and, as will be apparent from FIG. 6, the opening 17 of the ring is entirely free and unobstructed by any portion of device B. However, in the closed position size-reducing element 16 is fitted within opening 17 to effectively reduce the size of opening 17 and, as appreciated from FIG. 2, is interpositioned between the inner peripheral surface 18 of ring shank 10 and the palmar surface of the inserted finger 20.

The new device B is also provided with a feature, as described more fully below, for resiliently retaining size-reducing element 16 in the closed position shown in FIG. 1 and FIG. 2.

Setting 11 of ring A is seen to be of relatively heavy, elaborate character and as including the supports or structural members of the setting 13,14 extending upward from the sides of shank 10 so as to illustrate the suitability of device B for use with a relatively complex and unusual ring with which the various prior art arrangements for altering the size of the ring shank or hinging of the same could not effectively be utilized. In this regard, it is to be noted that ring shank 10 is also of a tapered configuration, as appreciated best from reference to FIG. 4 wherein the shank 10 is thicker at a bottom portion 25 than at an upper portion 26, a type of construction rendering most difficult the adaptation or use of a ring-securement device of the prior art. This is not to suggest, however, that the present device is utilizable only with rings of relatively complex and unsual character.

On the contrary, the numerous advantages of the new ring securement device B may be realized in conjunction with attachment of the same to a relatively simple ring, as well as those of complex or unusual configuration. Therefore, it is to be understood that the present description is not meant to limit in any way the use of the invention, nor to imply that use of ring securement device B is to be employed with only one or more of certain distinct types or configurations of rings. Ring A is, accordingly, depicted merely for purposes of illustration.

The specific features of ring securement device B are now described in greater detail. Size-reducing element 16 is of crescent shape, having a central portion 28 carried at the distal end of arm 24 and thence tapering laterally to the opposite sides of arm 24 and central portion 28 to reduced thickness opposite end portions 29, each of which is preferably provided with a blunted or rounded end 30.

Inasmuch as ring shank 10 may be of gold, silver, platinum or various alloys, size-reducing element 16, arm 24 and other members of ring securement device B may be of the same or similar metals or alloys in order to provide the identical appearance or luster of the ring.

Also, it will be immediately recognized that ring A is merely representative of one of many different possible sizes in which rings are conventionally available. However, it is not requisite that size-reducing element 16 provide a closely conformal fit within the inner peripheral surface 18 of the ring shank. The drawings illustrate, in fact, some difference in size. As a consequence, a size-reducing element of given dimensions can fit a number of different ring sizes. This is a substantial advantage for the manufacturing jeweler who may keep in stock a limited number of ring securement devices B having size-reducing elements 16 of only a few different sizes, but which will be utilizable for attachment to rings of many different sizes.

Attachment of the device is best understood by explication of the features of hinge means 21, which is seen to include a pair of tubular members 31, each being brazed or soldered by conventional jeweler's techniques, to the shank 10 of the ring as indicated at 32,33, so that the tubular hinge elements or members 31 are spaced apart on the outer peripheral surface 23 of ring shank 10 by a distance slightly greater than the width of arm 24.

Carried at the proximal end of arm 24 is a tubular hinge element extending transversely with respect to the arm and is secured to the arm in offset relationship with respect thereto so that it is located between tubular elements 31. A hinge pin 37 is receivable by each of the hinge elements 30 and 35 in a tightly fitted relationship and extends through each of the latter elements to provide a secure and mechanically simple hinging relationship between arm 24 and the ring.

The interconnection of size-reducing element 16 and arm 24 is preferably constituted by an integral relationship as by casting of the element 16 and arm 24 as a single piece. Arm 24 is of substantially thin, flat character throughout its extent between hinge element 35 and the central portion 28 of size-reducing element 16 with which it is interconnected. However, at the distal end, arm 24 tapers outwardly away from central portion 28 of element 16 to provide a wedge-shaped extension 38 having an outer shoulder 39 which is substantially coplanar with the surface 40 of the central portion 28 of element 16, which surface is to engage the finger 20 of the wearer as depicted in FIG. 2. Preferably, for purposes of comfort, the shoulder 40 of extension 38 is somewhat rounded, as best seen in FIG. 5.

Extension 38 serves a most useful purpose in that it is provided with a small aperture 42 in that face 43 of extension 38 which extends at a slight angle with rspect to the longitudinal axis of arm 24, such aperture being suited for receiving the tip 45 of an elongated tool 46 of pin-like character. Thus, the aperture is oriented for positioning of the tool transversely with respect to hinge means 21 with the tool being oriented as depicted in FIG. 4. The tool is utilizable by prying movement as depicted in the direction of arrows in FIG. 5 for disengaging size-reducing element 16 from its closed position.

As alluded to above, element 16 is resiliently retained in its closed position, i.e., that depicted in FIGS. 1, 2 and 4, by structural features of the device. For this purpose, a pair of rounded projections 48 are provided proximate respective opposite ends 30 of size-reducing element 16. Ring A is provided with a pair of indentations 50 in the innter peripheral surface 18 of ring shank 10 which respectively correspond to projections 48. It will be apparent that indentations 50 are adapted for receiving projections 48 to retain size-reducing element 16 in the closed position. The interengagement of these projections 48 with indentations 50 is shown by dashed lines in FIGS. 1 and 2.

By virtue of the resilient nature of arm 24 and element 16, the latter member is quite securely retained in closed position by the reception of projections 48 within indentations 50. Although the size-reducing element may be displaced by deliberate manual pressure applied to the surface of element 16 opposed from extension 40, the use of a tool 46 as depicted for prying open the device completely simplifies opening the size-reducing element even for those with limited movement of their hands, as is sometimes characteristically associated with arthritic affliction.

In this position of the ring A upon a finger of the wearer, it is manifest that size-reducing element 16 is first placed in the open position, as depicted in FIG. 6. Ring A may then be placed on the finger of the wearer, with the size-reducing element 16 extending outwardly from the ring, as illustrated in FIG. 7, so that arm 24 is above element 16 when the latter lies on the palmar surface of the ring finger 20. Accordingly, upon placing manual pressure against the arm extension 38, size-reducing element 16 is relocated to the closed position shown in FIG. 2 providing interengagement between the inner peripheral surface 18 of the ring and palmar surface of the finger 20 of the wearer.

When the ring is placed upon the finger and device B is configured as illustrated in FIG. 7, closure of size reducing element 16 is such that arm 24 bears against ring shank 10 as indicated at region 52 in FIG. 5, by virtue of the offset relationship of arm 24 with respect to the hinge axis defined by hinge pin 37 and also with respect to size-reducing element 16. Therefore, any attempt to pull the ring from the finger of the wearer, as through accidental application of force, serves only to cause arm 24 to bear even more tightly against the outer shank surface 52. In this way the size-reducing element is prevented by the arm from being displaced from the closed position upon attempted withdrawal of the ring from the finger.

However, upon insertion of a pointed object, such as tool 46 within aperture 42, simple prying movement of the tool will easily and quickly open the device for permitting withdrawal of the finger from the ring or readjustment, etc., although, manifestly, the same could be accomplished by manual pressure against the face of size-reducing element opposite from arm extension 38, if of sufficient magnitude.

A further feature of the invention may be noted as residing in the presentation of extension surface 39 against the palmer surface of the wearer's ring finger 20. Because of the relatively narrow transverse width of such surface 39, it is observed that surface 39 presses lightly into the fleshy palmar surface of the finger, as depicted in FIG. 2, in order to provide additional force resistant to twisting movement of the ring about the finger of the wearer. Thus, not only does the device securely affix the ring to the wearer's finger but also most desirably limits objectional twisting movement as might otherwise be prone to occur with such a top-heavy ring at that shown with its large heavy setting 11.

The device of the invention is most easily applied to any conventional ring, obviating the cutting away of the conventional shank and replacement with an adjustable shank or other cumbersome and objectionable modifications mandated by prior art efforts to solve the problem of effectively reducing the size of the ring opening upon placing the ring upon the finger of the wearer. A device of the present invention may be easily fixed to the ring by even relatively unskilled jewelers and in very short time, with consequent savings to the customer, as opposed to manifestly cumbersome, complex and intricate apparatus of the prior art. Moreover, it is a relatively simple matter should the device need to be removed, to detach the hinge members 30,31 from the ring shank, whereupon subsequent polishing of the shank surface returns the ring to its conventional character, leaving only the tiny indentations 50 on the inner surface of the shank which are not visible when the ring is worn.

Although the foregoing includes a description of the best mode contemplated for carrying out the invention, various modifications are contemplated. As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. In Combination with a finger ring having an opening for receiving the finger of a wearer, a device for securement of said ring upon the finger, said device comprising a size-reducing element configured for fitting within said opening for interposition between an inner peripheral surface of said opening and a palmar surface of the finger, hinge means for securement to an outer peripheral surface of a shank of the ring opposite from said inner peripheral surface without modification of said shank, and an arm interengaging said element and said hinge means, said arm being pivotal with respect to said hinge means to provide movement of said size reducing element between an open position, wherein said size-reducing element is displaced from said opening for permitting unobstructed insertion of the finger within said opening, and a closed position, wherein said size-reducing element is located within said opening and is interpositioned between said inner peripheral surface of said ring and a palmar surface of the inserted finger, and means for resiliently retaining said size-reducing element in said closed position, said arm being configured for bearing against a portion of the outer peripheral surface of said ring shank when said size-reducing element is in said closed position, said arm presenting said size-reducing element at the distal end of said arm, said size-reducing element being prevented by said arm from being displaced from said closed position by the bearing of said arm against said outer peripheral surface portion of said ring upon attempted movement of said ring along a finger of the wearer in one direction when said ring is upon said finger.

2. In combination with a finger ring, a device according to claim 1 and further characterized by said arm bearing against a portion of the outer peripheral surface of the ring which surface portion is oriented toward the distal end of said finger of the wearer when said ring is upon said finger.

3. In combination with a finger ring, a device according to claim 1 and further characterized by said device comprising an extension outward from said arm and proximate said size-reducing element, said extension being apertured for receiving an elongated tool, said aperture being oriented for positioning of said tool transversely with respect to said hinge means to permit rotation of said arm with respect to said hinge means upon prying movement of said tool for disengaging said size-reducing element from said closed position.

4. In combination with a finger ring, a device according to claim 1 and further characterized by said hinge means comprising first and second tubular hinge elements brazed to the outer periphery of said ring shank in spaced-apart relationship, said arm carrying a tubular hinge element extending transversely across a proximal end thereof, the latter being positionable between the first said hinge elements, and a hinge pin receivable by and extending through all of said tubular hinge elements.

5. In combination with a finger ring, a device according to claim 4 and further characterized by said size-reducing element being crescent-shaped and having a central portion carried at the distal end of said arm, said element extending transversely with respect to said arm.

6. In combination with a finger ring, a device according to claim 1 and further characterized by said means for resiliently retaining said size-reducing element in said closed position comprising projections proximate opposite ends of said size-reducing element, said ring being provided with indentations respectively corresponding to said projections for receiving the same to retain said size-reducing element in said closed position.

7. In combination with a finger ring, a device according to claim 1 and further characterized by said hinge means comprising at least one hinge element secured to the outer periphery of said ring shank, said arm having a proximal end carrying a hinge element secured pivotally to the first-said hinge element for relative movement on a hinge axis which is outside of said ring, said arm being adapted to extend radially with respect to said opening and to bear against a portion of the outer peripheral surface of said ring shank when said size-reducing element is in said closed position, said arm being offset with respect to said hinge axis and with respect to said size-reducing element.

* * * * *